United States Patent [19]

Farrell et al.

[11] Patent Number: 4,995,657

[45] Date of Patent: Feb. 26, 1991

[54] FASTENER FOR SECURING THE CLOSURE OF A CONTAINER

[75] Inventors: Grant D. Farrell; Edward Goles, both of Pickering, Canada

[73] Assignee: Scepter Manufacturing Company Limited, Toronto, Canada

[21] Appl. No.: 299,435

[22] Filed: Jan. 23, 1989

[51] Int. Cl.[5] ..... E05B 39/02

[52] U.S. Cl. ..... 292/327

[58] Field of Search ..... 292/307, 316, 317, 318, 292/319, 320, 321, 322, 327, 331

[56] References Cited

U.S. PATENT DOCUMENTS

| | | | |
|---|---|---|---|
| 1,826,033 | 10/1931 | Webster | 292/307 R |
| 3,768,849 | 10/1973 | Sytko | 292/327 |
| 4,082,336 | 4/1978 | Natkins | 292/318 |
| 4,354,298 | 10/1982 | Tanaka et al. | 292/327 X |
| 4,658,481 | 4/1987 | Seyler et al. | 292/307 R X |
| 4,658,955 | 4/1987 | Eichner | 292/307 R X |
| 4,664,432 | 5/1987 | Swift | 292/328 |
| 4,793,641 | 12/1988 | Sokol | 292/322 |

*Primary Examiner*—Gary L. Smith
*Assistant Examiner*—Michael J. Milano
*Attorney, Agent, or Firm*—Brian W. Gray

[57] ABSTRACT

The invention concerns a fastener for locking the closures of containers, particularly ammunition containers. A container and a closure each have ring means which form coaxially aligned bores when the container is fully closed. The fastener comprises an upper and lower body, each of which is provided with a projection means. The projection means attached to the lower body is dimensioned to be pushed through the bore formed by the aligned rings in a first direction, but is prevented from being removed from the bore in a second opposite direction. When it is required to open the container, the fastener is pulled with a force in excess of 5 lbs. and the projection means attached to the lower body is torn from the fastener. The lower body of the fastener is moulded in a collapsed form for subsequent assembly. The fastener can be quickly and conveniently applied and removed from containers without the use of tools.

16 Claims, 3 Drawing Sheets

FASTENER FOR SECURING THE CLOSURE OF A CONTAINER

FIELD OF THE INVENTION

This invention relates to fasteners and in particular fasteners used for locking the closures of containers, for example containers used for transporting or storing ammunition.

BACKGROUND OF THE INVENTION

This invention relates to fasteners for locking the closures of containers, and in particular, containers used for the transportation and storage of ammunition such as shells, missiles, torpedoes, bombs and other more general projectiles.

Usually ammunition of this type is transported or stored in tube-like containers such as are disclosed in U.S. Pat. No. 3,939,967 to Tenney et al and U.S. Pat. No. 4,666,034 to Johnson et al. Such containers comprise a tube or box-like lower portion and a conforming upper portion; the upper and lower portions mate to provide a closed container for the ammunition. In the Tenney et al patent, the upper and lower portions are secured together by a threaded engagement; in the Johnson et al patent, the upper portion is provided with a central threaded rod which can be rotated into a tube attached to the base portion, thereby releasably securing the upper and lower portions. Neither of these patents disclose a means for locking the upper and lower portions of the ammunition container together.

It is desirable to have a means of securing the closure of an ammunition container for two main reasons. Firstly, it is possible that such threaded closures become loose or open when jarred by transportation across rough terrain or by nearby explosions; in such situations a lock would prevent such accidental opening. Secondly, it is necessary to provide a security lock to the closure with which it is possible to detect if the ammunition container has been opened by an unauthorized person.

One technique in current use for detecting whether the closure of a container has been opened, involves the use of a wire passed through two aligned holes, one of which is attached to the closure, the other attached to the container. The ends of the wire are fastened together by means of a metal tag which is crimped to the ends of the wire. If the tag is broken or the wire is severed or missing, one is immediately alerted to the fact that the container has been opened or tampered with. This type of wire seal must be applied to a container using tools, such as pliers, to crimp the tag to the ends of the wire, and in addition, tools, such as metal cutters, are required to remove the wire seal. The use of tools to remove the wire seal is a particular disadvantage for ammunition containers since it is time consuming and leads to an inefficient manner of unloading the ammunition in the field.

Closures for ammunition containers therefore have two conflicting requirements. Firstly, the closures must be made secure to prevent them becoming inadvertantly jarred loose and to prevent tampering with the ammunition. Secondly, the closures must be capable of being opened quickly and easily, to gain swift access to the ammunition under field conditions. The fastener constructed in accordance with this invention seeks to fulfill both of these requirements. It can be applied swiftly and without tools to a container to lock and secure the closure, and when the container is required to be opened, the fastener can be swiftly removed without the aid of tools. In addition, once removed, the fastener cannot be reapplied to the container, its absence thereby indicating that the container has been opened or tampered with.

Further, since the closure is made of plastic, it is useful if the fastener is in a form that it can be easily injection molded, even if some simple subsequent assembly is required.

SUMMARY

The present invention provides a fastener for securing a closure to a container, in which the closure has a first ring means and the container has a second ring means, such that when the closure and the container are fully engaged, the first and second rings are coaxially aligned, thereby providing a bore through both the first and second rings. The fastener comprises an upper and lower body. The lower body has a first projections means, such as a single flange or several locking tangs, which is dimensioned so that the lower body can be inserted through the bore in a first direction, but is prevented from moving in a second direction (substantially opposite to the first direction) by abutting the surface surrounding the bore. The upper body also has a second projection means, for example a flange, which is located some distance in the second direction from the lower body projection means, which prevents the upper body from moving in the first direction, again by abutting the surface surrounding the bore. During the removal of the fastener from the container, at least one of the projection means, preferably first the one attached to the lower body, is detached from the fastener, and cannot be reattached. It is thereby not possible to reattach the fastener, and an indication is given that the container has either been opened or tampered with. In order to achieve this, the projection means may be attached to the fastener by means of a relatively thin web which is capable of being torn during the removal of the fastener.

In the preferred embodiment of the invention, the lower body comprises a core section surrounded by an outer section attached to the core by a relatively thin web which is torn during removal of the fastener. During removal, the outer section is held fast against the surface surrounding the bore by means of the projection means attached to the outer section, and the core moves relative to the outer section. As the core moves it tears the thin web connecting the core to the outer section. The outer section is itself comprised of two wings to which the projection means are attached.

A convenient method of manufacturing the fastener is to mould the lower body in a semi-finished collapsed form that is subsequently assembled. In this form, a groove is moulded into a first end of the core section and a base plate is attached to the second end of the core by means of a hinge. The two wings are moulded to the base plate by thin webs, capable of being torn during removal of the fastener, and the projection means is moulded to the outer surface of each wing. The wings are provided with lug means adapted to engage the groove in the core section such that the base plate can be folded about the hinges and the wings can be folded about the thin webs so that the base plate and the wings abut against the core and the lug means snaps into the groove in the core, thereby clipping the wings around the core.

The fastener may also have a handle means for pulling the fastener from the aligned holes. The handle can be embellished with a label or emblem giving details of the contents of the container.

REFERENCE NUMERALS

Figure 1:
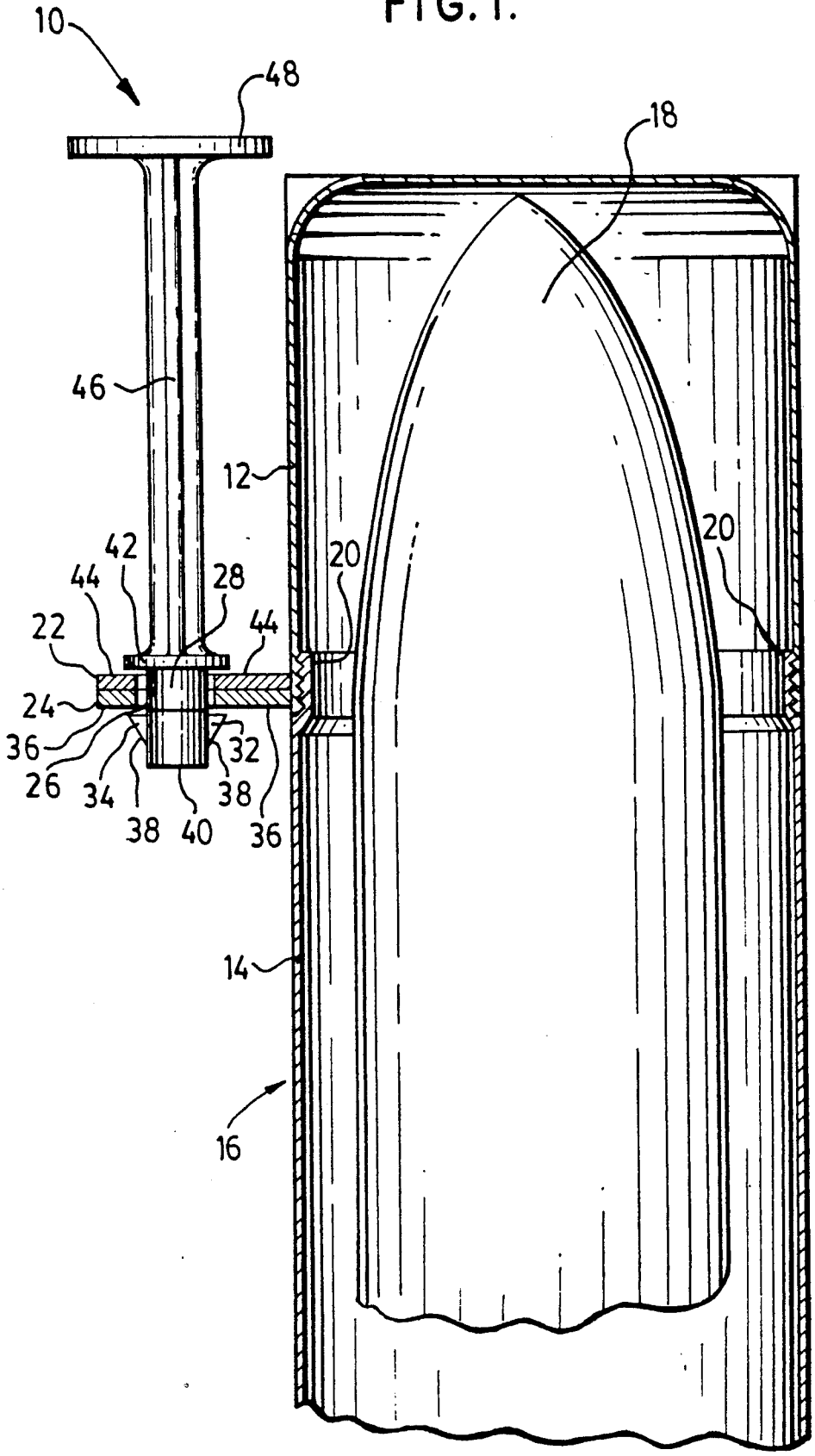
FIG. 1 is a side view showing an ammunition container in section locked by means of a fastener constructed in accordance with the present invention.

10 Fastener
12 Upper portion of storage container
14 Lower portion of storage container
16 Storage container
18 Projectile
20 Threads for attaching upper and lower portions of container together
22 Top closed ring
24 Bottom closed ring
26 Base through closed rings
28 Upper body of fastener
30 Lower body of fastener
32 Projection means (locking tangs)
34 Projection means (locking tangs)
36 Lower surface of the bottom ring
38 Lower face of tang
40 Base of fastener
42 Flange
44 Upper surface of top ring
46 Stem
48 Handle
50 Semi-finished fastener
52 Lower body (collapsed form)
54 Core
56 Core side
58 Core side
60 Core end
62 Core end
64 V-shaped groove
66 Base plate
68 hinge (base plate to core)
70 wing
72 hinge (wing to base plate)
74 inner face of wing
76 outer face of wing
78 lug

DESCRIPTION

Referring to FIG. 1, reference numeral 10 represents a fastener constructed in accordance with the present invention. The fastener 10 is shown locking together the upper 12 and lower 14 portions of a storage container 16 for artillery shells, missiles, projectiles or the like. The container 16 in FIG. 1 is illustrated as housing a projectile 18, however the fastener 10 can be used to lock any container which houses goods that are required to be kept secure. In FIG. 1 the upper and lower portions of 12, 14 of the storage container 16 are shown fastened together, for example, by some threaded means 20, to form a storage container 16 in which the projectile 18 is completely enclosed.

Attached to the upper portion of the container 12 is a top closed ring 22 and similarly, attached to the lower portion of the container is a bottom closed ring 24. When the upper and lower portions of the container, 12, 14 are fully engaged, for example by tightening the threads 20, rings 22 and 24 are aligned coaxially and thereby create a bore 26 which passes through both rings 22, 24. The fastener 10, which in FIG. 1 is shown located in the bore 26, includes an upper body 28 and a lower body 30. Attached to the lower body 30 is a first projection means, which, may consist of several individual locking tangs. In FIG. 1, two locking tangs 32, 34, are shown, projecting from the lower body 30. The first projection means may also consist of a single projection completely encircling the lower body 30. The function of the tangs 32 and 34 is to prevent the lower body 30 of the fastener 10 from moving in an upward direction through the bore 26. When the fastener 10 is moved in an upward direction relative to the container 16 in FIG. 1, tangs 32 and 34 abut against the lower surface 36 of the bottom ring 24, thereby preventing further upward movement of the fastener 10. However, in addition to preventing the fastener 10 from being pulled upward through the bore 26, the tangs 32, 34 must also be of a size and shape that enable them to pass through the bore 26 in a downward direction relative to the container 16 in FIG. 1 when the fastener 10 is being applied to the container 16. In FIG. 1, the lower faces 38 of the tangs 32, 34 are at 45° to the lower body 30 and tapered towards the base 40 of the fastener 10, thereby enabling the lower body 30 to be pushed through the rings 22, 24 from above. The tangs 32, 34 are made of a resilient material which allows them to deform elastically as they are pushed through the bore 26 and resume their shape once they have passed completely through the bore 26.

Attached to the upper body of the fastener 28, is a second projection means which, for example, in FIG. 1 is shown to be a flange 42. The flange 42 abutts against the upper surface 44 of the top ring 22 when the fastener 10 is moved in a downward direction relative to the container 16 in FIG. 1, thereby preventing the fastener 10 from passing downwards through the bore 26. The flange 42 and the tangs 32, 34 are a spaced distance apart along the vertical axis of the fastener 10, with the upper body 28 located between the flange 42 and the tangs 32, 34. When the tangs 32, 34 are pushed through the rings 22, 24, the upper body 28 is positioned in the bore 26 created by the rings 22, 24, as shown in FIG. 1.

The fastener 10 is also provided with a stem 46, attached at its first end to the flange 42, and a handle 48 attached to the second end of the stem 46. The stem 46 and the handle 48 enable a person opening the container 16 to establish a convenient and firm hold of the fastener 10. The mode by which the fastener 10 is applied and removed from the container 16 is described in more detail below. The length of the stem 46 and the shape of the handle 48 are largely dictated by the shape of the container 16 to which the fastener 10 is being attached. For example, regarding the container 16 shown in FIG. 1, it is convenient to have a long stem 46, whereby the handle 48 is positioned clear of the upper portion of the storage container 12, so giving plenty of space for a person's hand to grip the fastener 10.

The handle 48 can be of a disc shape, the surface of which may be embellished with some label or emblem which gives information regarding the contents of the container 16.

The fastener 10 can be moulded in any suitable thermoplastic material such as polyethylene (linear, high and low density types), polypropylene and other related polymers. Other materials such as thermosetting compounds, natural and synthetic rubbers may also be used.

Figure 2:
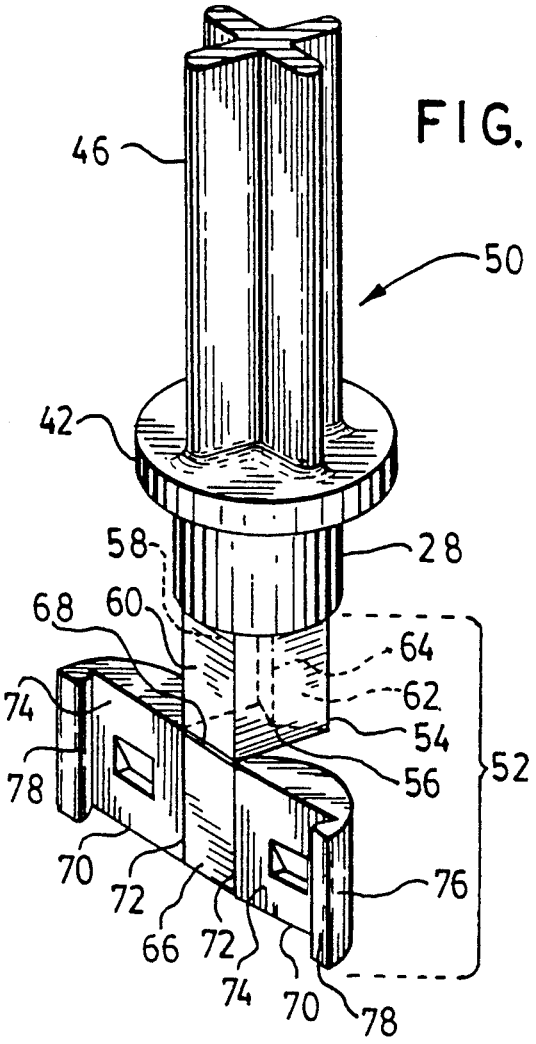
FIG. 2 shows the semi-finished fastener after moulding.

The fastener 10 is moulded as a semi-finished product which is subsequently assembled by a folding operation into the final product. FIG. 2 shows the semi-finished fastener 50 as it is moulded (the handle 48 and part of the stem 46 have been omitted for purposes of clarity).

The stem of the fastener 46 is moulded at one extremity to the handle 48 and at the other extremity to upper surface of the flange 42. The lower surface of the flange 42 is attached to the upper body of the fastener 28. The lower body 30 is moulded in a collapsed form indicated by the reference numeral 52 in FIG. 2, and is subsequently assembled in an operation described in more detail below. The collapsed form 52 comprises a core section 54, moulded to the lower surface of the upper body 28. The core has sides 56 and 58 and ends 60 and 62. A V-shaped groove 64 is moulded into core end 62, and has a width and length substantially the same as the width and length of core end 62. A base plate 66 having similar shape and area as core end 60 is attached along one side to the lower edge of core end 60 by means of a hinge section 68. The hinge 68 is formed from a section of moulded material that is relatively thin compared with the thickness of the base plate 66.

Attached to each side of the base plate 66 is a wing section 70. Each wing is attached to the base plate 66 by a hinge section 72 which is formed from moulded material that is significantly thinner than the thickness of hinge section 68, which attaches the base plate 66 to the core 54. The wings 70 have substantially planar inner faces 74 which have similar shape and area as core sides 56, 58. The outer faces 76 of the wings 70 are curved, having substantially a semi-circular profile. A lug section 78 extends along the entire length of the free end of each wing 70. The function of the lugs 78 is described in more detail below. Projection means, for example tangs 32, 34, are moulded in each wing 70 and project from the outer curved surface 76 as can be seen more clearly in FIG. 3(*a*).

Figure 3:
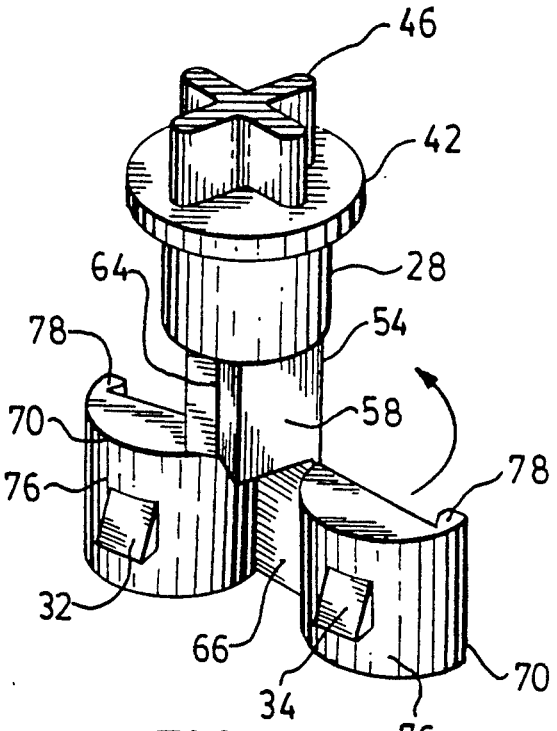
FIG. 3 shows the stages of assembling the semi-finished fastener into the final product.
Figure 3B:
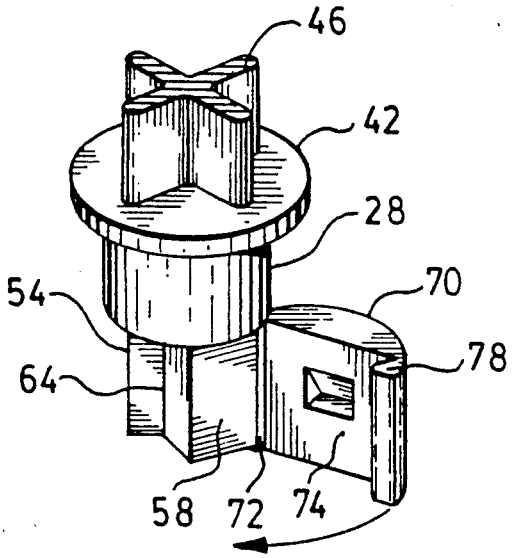
Figure 3:
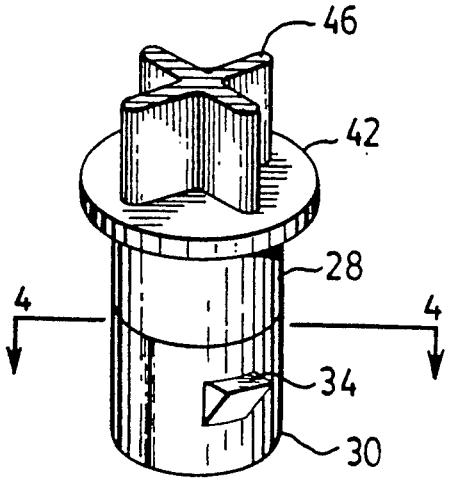

FIGS. 3(*a*) to 3(*c*) show how the lower body of the fastener 30 is assembled from the collapsed form 52 shown in FIG. 2. In FIG. 3(*a*), the base plate 66, to which the wings 70 are attached, is folded upwards about hinge 68 in the direction of the arrow in FIG. 3(*a*). The face of base plate 66 lies in contact with core end 60; both base plate 66 and core end 60 being of the same size and shape.

In FIG. 3(*b*), the wings 70 are folded towards groove 64 in the core 54. For example, the wing 70 is folded in the direction of the arrow in FIG. 3(*b*) until the lug 78 snaps into place in groove 64. At this point, the inner planar face 74 of the wings 70 lies flat against core side 58 since face 74 and side 58 are of the same size and shape. When both wings 70 are snapped into groove 64, the lower body 30 of the fastener is fully assembled, with the core section 54 surrounded by an outer section comprised of the wings 70, as shown in FIG. 3(*c*).

Although in the preferred embodiment of the fastener 10 both an upper body 28 and a lower body 30 are defined, it would also be possible to mould a fastener without an upper body 28 as such. In a fastener of this type, the core 54 and the wings 70 would extend to flange 42, while maintaining the required distance between the flange 42 and tangs 32, 34. In this way, the upper body 28 is in effect moulded in a collapsed form, integral with the lower body 30.

Figure 4:
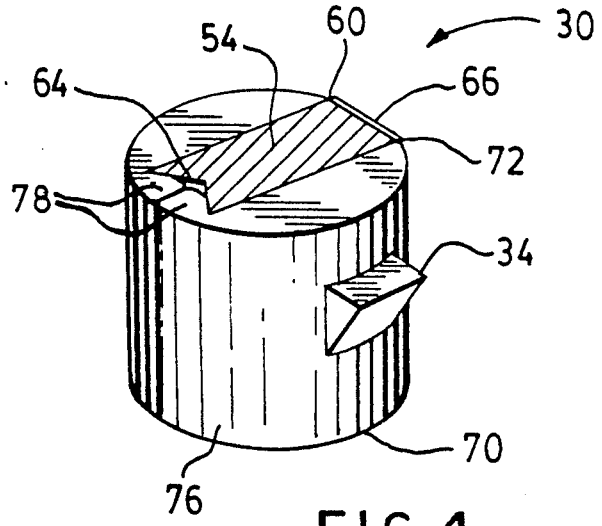
FIG. 4 is a section through 4—4 in FIG. 3(*c*)

FIG. 4 is a section taken along AA in FIG. 3(*c*), showing the assembled structure of the lower body 30. The core 54 is sandwiched between the two wings 70. The wing lugs 78 deform elastically when they snap into groove 64 and thereby grip the core 54. The wings 70 are also held to the core 54 through hinges 72 which link the wings 70 to the base plate 66. The tension that exists in the wings 70, by virtue of the lugs 78 snapping into groove 64, ensures that the base plate 66 lies flat against the core end 60.

Once assembled, the fastener 10 can be applied to a container 16 in the following manner.

The upper and lower portions of the container 12, 14 are engaged such that rings 22, 24 are coaxially aligned. It is then possible to push the lower body 30 of the fastener 10 through the rings 22, 24 because of the tapered face 38 and resilience of tangs 32,34. Once the tangs have been pushed through the rings 22, 24 and through their elasticity, resume their original shape, the fastener 10 is in place. It is neither possible to push further the fastener 10 through the rings 22, 24, since this is prevented by the abuttment of the flange 42 against the upper surface of the top ring 44, nor is it possible to withdraw the fastener 10 because the abuttment of tangs 32, 34 against the lower surface of the bottom ring 36.

Figure 5:
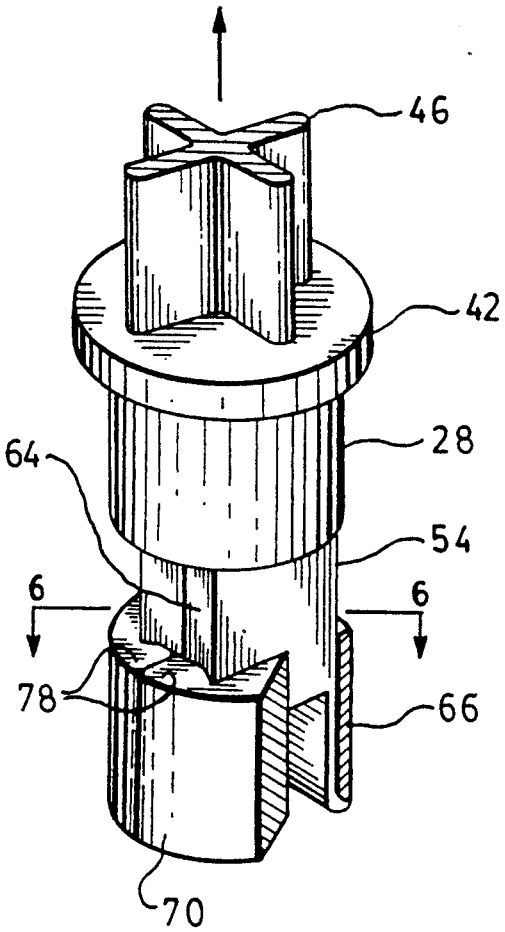
FIG. 5 shows the fastener during opening.
Figure 6:
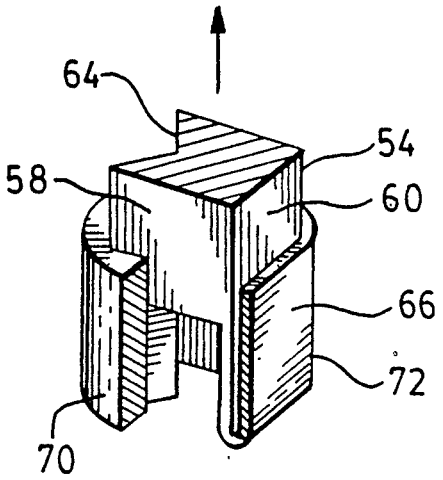
FIG. 6 is a section through 6—6 in FIG. 5 which is rotated 45° clockwise about its longitudinal axis.

Although once in place the fastener 10 is prevented from moving either upwards or downwards, as described above, it can nevertheless be removed when required from rings 22, 24 by applying a tensile force greater than about 5 lbs. to the handle 48 or stem 46. When such a force is initially applied to the fastener 10, the tangs 32, 34 abutt against the lower surface of the bottom ring 36 and hold the lower body of the fastener 30 fast with respect to the lower ring 24. With increasing tensile force, the thin plastic membranes which constitute hinges 72 begin to tear. It is the thin hinges 72 which attach the wings 70 to the base plate 66 which tear, rather than the hinge 68 between the core 54 and the base plate 66, since hinge 68 is moulded in thicker material and hence is stronger than hinges 72. As hinges 72 tear, the core 54 is free to move upwards in the direction of the force, as shown in FIGS. 5 and 6. Although the wings 70 to which the tangs 32, 34 are attached are held fast, the core 54 is free to move since it is only attached to the wings 70 by means of hinges 72. Continued application of the tensile force continues to tear the hinges 72 until they are completely torn, at which point the core 54 is detached from the wings 70 and the lower body 30. It is now possible to pull the fastener 10 clear from the rings 22, 24, and the container 16 can be opened. It is important that the wings 70 are free to fall clear of lower ring 24 before the container 16 can be opened.

It is apparent that, since core 54 is irreversibly torn from the wings 70, it is not possible to re-use the fastener to lock the container 16. In this way, the absence of the fastener 10 is a tell-tale signal that the container 16 has been unlocked and alerts to the fact that the contents may have been tampered with.

We claim:

1. A fastener for securing a closure to a container, in which the closure has a first ring means and the container has a second ring means, such that when the closure and the container are fully engaged, the first and second ring means are coaxially aligned, thereby providing a bore through both the first and second ring means, the fastener comprising:

(a) a body having a longitudinal axis;

(b) the body having first projection means dimensioned such that the body can be inserted through the bore in a first direction along its longitudinal axis but is prevented from moving in a second direction, being 180° to the first direction, by abutting the surface surrounding the bore;

(c) the body having second projection means located at a distance in the second direction from the first projection means, that prevents the body from moving in the first direction by abutting the surface surrounding the bore;

(d) at least one of the projection means is capable of being detached from the fastener by tearing away from the body during removal of the fastener from the container by movement in either the first or second direction;

(e) the body comprising a core section surrounded by an outer section to which is attached the first projection means such that during removal of the fastener in a second direction, the outer section is held fast against the surface surrounding the bore by means of the first projection means and the core moves relative to the outer section.

2. The fastener in claim 1 wherein one of the projection means is attached to the fastener by a relatively thin web which is capable of being torn during the removal of the fastener from the container.

3. The fastener in claim 1 wherein the projection means is attached to the body by means of a relatively thin web which is torn and thereby detached during the removal of the fastener from the container in the second direction.

4. The fastener in claim 3 wherein the projection means comprises several locking tangs.

5. The fastener in claim 3 wherein the second projection means comprises a single flange.

6. The fastener in claim 1 wherein the detached projection means cannot be reattached to the fastener, thereby indicating that the container has been tampered with.

7. The fastener in claim 1 wherein a force greater than about 5 lbs. is required to remove the fastener from the ring means.

8. The fastener in claim 1 wherein the outer section is attached to the core by a relatively thin web which is capable of being torn during the removal of the fastener from the container.

9. The fastener in claim 8 wherein the outer section comprises two wings to which the first projection means are attached.

10. The fastener in claim 1 wherein the core section has a first end, into which a groove is moulded and the outer section comprises:

(a) a base plate attached to the second end of the core section by means of a first hinge;

(b) at least two wings, each attached to the base plate by means of a second hinge of relatively thin web which is capable of being torn during removal of the fastener for the purpose of opening the container;

(c) lug means moulded to each wing, adapted to engage the groove moulded into the core section;

such that, the base plate can be folded about the first hinge so that the base plate contacts the core section and the wings can be folded about the second hinges so that they contact the core section and the lug means engage the groove moulded into the core section.

11. The fastener in claim 10 wherein the core section and the wings extend to the second projection means, the upper body thereby being moulded in a collapsed form integral with the lower body.

12. The fastener in claim 10 further comprising a handle means for pulling the fastener from the aligned rings.

13. The fastener in claim 13 wherein the handle means is embellished with a label or emblem.

14. A fastener for securing a closure to a container, in which the closure has a first ring means and the container has a second ring means, such that when the closure and the container are fully engaged, the first and second ring means are coaxially aligned, thereby producing the bore through both first and second means, comprising:

(a) a lower body wherein the lower body includes a core section having a first end into which is moulded a groove; a base plate attached to the second end of the core section by means of a first hinge; two wing elements, each attached to the base plate by means of a second hinge of relatively thin web which is capable of being torn during removal of the fastener for the purpose of opening the container, and cannot be reattached to the fastener; lug means moulded to each wing, adapted to engage the groove moulded into the core section; the lower body, base plate, wing elements and lug means dimensioned such that they can be inserted through the bore in a first direction, but be prevented from moving in a second direction, being 180° to the first direction, by abutting the surface surrounding the bore;

(b) an upper body having a second projection means, located at a distance in the second direction from the first projection means, preventing the upper body from moving in the first direction by abutting the surface surrounding the bore;

(c) a handle means for pulling the fastener from the aligned ring.

15. The fastener in claim 14 wherein the fastener is manufactured in polyethylene.

16. A method of manufacturing the fastener of claim 10, comprising:

(a) moulding a core section having a first end, in which a groove is moulded; a base plate which is attached to the second end of the core section by means of a first hinge; two wings, each attached to the base plate by means of the second hinge of relatively thin web which is capable of being torn during removal of the fastener for the purpose of opening the container; lug means on the end of each wing, adapted to engage the groove moulded into the core section;

(b) folding the base plate about the first end so that the base plate contacts the core section;

(c) folding the wings about the second hinges so that they contacts the core section;

(h) engaging the lug means into the groove moulded into the core section.

* * * * *

UNITED STATES PATENT AND TRADEMARK OFFICE

CERTIFICATE OF CORRECTION

PATENT NO. : 4,995,657

DATED : February 26, 1991

INVENTOR(S) : Grant D. Farrell, et al

It is certified that error appears in the above-identified patent and that said Letters Patent is hereby corrected as shown below:

In column 2, line 8, delete "useful-if" and substitute --useful if--.
In column 2, line 34, replace "preferably first the one" with --preferably the first one--.
In column 2, line 20, replace "projections" with --projection--.
In column 6, line 7, delete "AA" and substitute --4-4--.
In column 7, claim 4, line 1, after the phrase "wherein the" insert the word --first--.
In column 8, claim 13, line 1, delete the words "claim 13" and insert the words --claim 12--.

Signed and Sealed this

First Day of December, 1992

*Attest:*

DOUGLAS B. COMER

*Attesting Officer*

*Acting Commissioner of Patents and Trademarks*